US010030478B2

(12) United States Patent
Johnson et al.

(10) Patent No.: US 10,030,478 B2
(45) Date of Patent: Jul. 24, 2018

(54) MECHANICALLY ACTUATED VARIABLE CHOKE SYSTEM FOR SUBTERRANEAN USE

(71) Applicant: BAKER HUGHES INCORPORATED, Houston, TX (US)

(72) Inventors: Michael H. Johnson, Katy, TX (US); Steve Rosenblatt, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 325 days.

(21) Appl. No.: 14/282,662

(22) Filed: May 20, 2014

(65) Prior Publication Data

US 2015/0337628 A1 Nov. 26, 2015

(51) Int. Cl.
*E21B 34/14* (2006.01)
*E21B 23/00* (2006.01)
*E21B 43/12* (2006.01)

(52) U.S. Cl.
CPC ..... *E21B 34/14* (2013.01); *E21B 23/00* (2013.01); *E21B 43/12* (2013.01)

(58) Field of Classification Search
CPC ..... E21B 34/14; E21B 43/12; E21B 23/00
See application file for complete search history.

(56) References Cited

U.S. PATENT DOCUMENTS 4,998,576 A 3/1991 Moreno
6,949,561 B1 9/2005 Reed et al.
8,171,994 B2 * 5/2012 Murray ..... E21B 43/02 166/177.5
8,186,439 B2 5/2012 Lauderdale
2004/0007356 A1 * 1/2004 Myron ..... E21B 34/14 166/240
2007/0295514 A1 * 12/2007 Rohde ..... E21B 23/006 166/386
2010/0263871 A1 * 10/2010 Xu ..... E21B 33/10 166/308.1

OTHER PUBLICATIONS

Accessed Oilfield Glossary from Schlumberger for definition of j-slot on May 24, 2016 via www.glossary.oilfield.slb.com.*

* cited by examiner

*Primary Examiner* — Giovanna C. Wright
*Assistant Examiner* — Manuel C Portocarrero
(74) *Attorney, Agent, or Firm* — Steve Rosenblatt

(57) ABSTRACT

A series of independently operated chokes, using a shift tool in registry with a profile discrete to each choke, have a tubular valve member that aligns or misaligns openings for the fully open or closed positions for the choke and for intermediate positions as the valve opens or closes. The valve member is actuated axially using a reversing screw and a j-slot. A shifting tool latches a unique profile to operate the j-slot to cause a sleeve to rotate in place. The sleeve has a pin in registry with a profile on a profile shaft. The profile shaft can move axially in opposite direction but is restrained against rotation. The profile is shaped so that continuous j-slot operation causes the registered pin to move in the profile to then axially drive the profile shaft which is connected to the valve member.

19 Claims, 1 Drawing Sheet

MECHANICALLY ACTUATED VARIABLE CHOKE SYSTEM FOR SUBTERRANEAN USE

FIELD OF THE INVENTION

The field of the invention is mechanically actuated valves that are used to balance flow or isolate flow among producing or injection zones and more particularly where the valves can be adjusted into multiple open positions and a closed position.

BACKGROUND OF THE INVENTION

In the drilling and completion industries it is often desirable to affect tools or formations at a great distance from a surface located facility such as a rig, production facility, or wellhead. One example of an operation intended to affect a formation production is manipulation of a downhole choke to adjust flow rates from or into various zones or reservoirs segments. In order to perform such an operation, a choking mechanism can be actuated either hydraulically, electrically or the combination of these means. In the art, using these types of control generally require a number of control lines run from the surface through the wellhead related to changing the choke sizes at discrete locations in the wellbore. Such tools increase expense initially and generally create other issues to be overcome during well construction and completion operations. Where multiple choking locations are contemplated, generally control lines must pass through packers and other wellbore devices to allow a choking system be installed and administered correctly for it to work. Since choke adjustment happens infrequently the system of control lines is rarely used and only complicates well construction and completion operations.

Instead a far simpler system is contemplated where each valve has a unique profile for engagement by a shifting tool so that axial movement of the shifting tool will actuate a j-slot to rotate a pin extending from a sleeve that is in registry with a shaft having a reversing screw profile. Operation of the j-slot moves the pin in the track of the profiled shaft. The profiled shaft is constrained against rotation but is free to move axially in opposed direction. The choke valve member is tied to the translating profile shaft to allow the choke to move between fully open and fully closed and into positions in between. The profile shaft reverses direction at the fully open and fully closed positions of the choke to accomplish the closed, full open and part open positions that are in between.

Reversing screws are known and described in U.S. Pat. No. 4,998,576 in the context of a window mechanism. Typically the profile shaft is fixed against lateral movement and its rotation on its own axis drives a follower in opposed directions. The operation in the present invention is reversed in that a j-slot drives the follower along the profile on the profile shaft that is restrained against rotation so that rotational movement of what has traditionally been the follower in effect causes the profile shaft to move axially in opposed directions within a predetermined travel range.

A series of chokes accessible to a tool that engages unique profiles make it possible to balance flows from or into zones or to completely close off zones as desired. The system is economical as compared to systems that require control lines or power to drive motors at various locations. Other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A series of independently operated chokes, using a shifting tool in registry with a profile unique to each choke, have a tubular valve member that aligns or misaligns openings for the fully open or closed positions for the choke and for intermediate positions as the valve opens or closes. The valve member is actuated axially using a reversing screw and a j-slot. A shifting tool latches a unique profile to operate the j-slot to cause a sleeve to rotate in place. The sleeve has a pin in registry with a profile on a profile shaft. The profile shaft can move axially in opposite direction but is restrained against rotation. The profile is shaped so that continuous j-slot operation causes the registered pin to move in the profile to then axially drive the profile shaft which is connected to the valve member.

DETAILED DESCRIPTION OF THE PREFERRED EMBODIMENT

Figure 1:
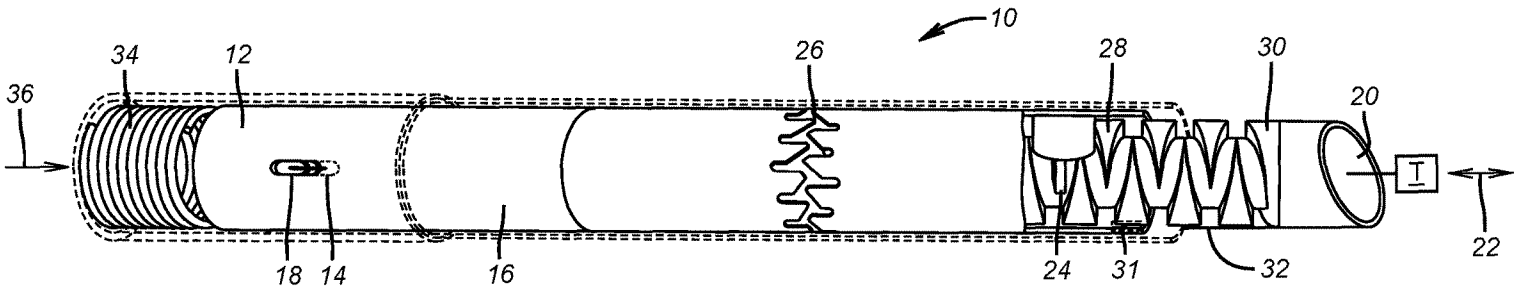
FIG. 1 is a perspective view of the major components of one of the variable choke valves that can be deployed at a subterranean location.
Figure 2:
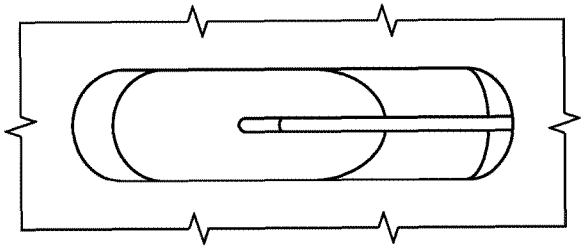
FIG. 2 is a detailed view of the choke valve shown in a partly open position.

FIG. 1 illustrates the main components of the tool 10. An outer housing 12 forms a part of a tubular string that is not shown and has one or more ports 14 that can be operated at fully open, fully closed and at least one position in between. In the preferred design there are increments of opening or closing and the ports 14 open incrementally to full open at which point further actuation reverses the movement increments of a valve member 16 that has at least one port 18 that preferably has the same shape as the at least one port 14. The valve member is preferably a tubular shape with the port or ports 18 and it moves axially in opposed directions for the more open and the more closed position changes. This axial movement is initiated using a unique profile 20 on the uphole end that can be engaged by a shifting tool, schematically illustrated as T, having a pattern that matches the profile 20 for engagement and axial direction manipulation in opposed directions indicated by arrow 22. Support for the tool T is omitted but it can be slickline, coiled tubing or rigid tubing to give a few examples.

Figure 3:
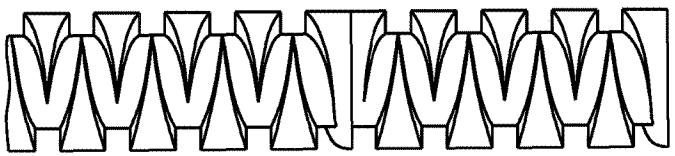
(PRIOR ART) FIG. 3
FIG. 3 is a view of a known reversing screw showing a follower in a profile groove in the rotating and axially fixed profile shaft that is adapted for use with the chokes of the present invention.

Axial manipulation of profile 20 and the presence of the j-slot pattern 26 causes pin 24 to rotate. Pin 24 sits in the self-reversing profile 28 of shaft 30 that is enabled to move axially in the directions of arrow 22. However shaft 30 is keyed 31 to prevent rotation by a key that is not shown but that engages in elongated slot 32. Thus in order for the pin 24 to progress in helical reversing profile 28, the shaft 30 has to translate in the directions of arrow 22. Axial movement of shaft 30 causes a similar tandem movement in valve member 16. There is a return bias 34 that can be a spring or pressurized compressible gas that provides a force in the direction of arrow 36. The profile 28 defines angular movement increments of pin 24 along the profile 28, which, in turn, defines a predetermined axial movement of shaft 30 and valve member 16 either toward alignment or misalignment of opening 18 with opening 14. FIG. 3 illustrates in detail a reversing profile and a follower in registry with the profile for reversing back and forth movement of the follower as the shaft with the profile rotates on its own axis without translating.

Each such tool 10 can be operated with the shifting tool T when a different profile is fitted. In such a manner the flows from the formation in production or into the formation when injecting can be balanced to get the desired result of controlling water or sand production, for example. Particular zones can be closed entirely. The shifting tool can carry multiple profiles with a facility to expose different profiles for engagement with mechanical or hydraulic inputs such as to shift cover sleeves away from designated profiles so that more than one tool 10 can be shifted in a single trip into the borehole. The tools 10 are independently mechanically operated taking away the need for control lines or power cables to actuating motors that increase expense encountered by the prior designs that used hydraulic or electric motor drivers.

The above description is illustrative of the preferred embodiment and many modifications may be made by those skilled in the art without departing from the invention whose scope is to be determined from the literal and equivalent scope of the claims below:

We claim:

1. A choke assembly for flow control between a formation and a tubular string extending to subterranean locations, comprising:

at least one housing having at least one wall port and a passage therethrough and end connections for securing said housing as a component of the tubular string;

a tubular valve member assembly within said at least one housing defining a passage therethrough and at least one tubular valve member port, said tubular valve member assembly responsive to multiple cyclical opposed axial movements from within the tubular string makes stops at incremental increases responsive to a cycle of said opposed axial movements to full overlap between said at least one tubular valve member port and said at least one wall port;

said incremental increases produced with a j-slot assembly operably connected between said tubular valve member and said housing, said incremental increases created by rotational movement of a pin located outside said j-slot assembly in an associated self-reversing profile located at an axially spaced location from said j-slot assembly, said self-reversing profile restrained to move axially responsive to rotation of said pin to accomplish said incremental increases by movement of said valve member;

whereupon, at the full overlap position, said pin automatically reverses rotation direction responsive to further said multiple cyclical opposed axial movements for stops at incremental decreases to a no overlap position between said at least one tubular valve member port and said at least one wall port by virtue of doubling back movement of said valve member caused by reversal of axial movement direction by said self-reversing profile.

2. The assembly of claim 1, wherein:

said valve member assembly comprises a latching profile for engagement by a shifting tool.

3. The assembly of claim 1, wherein:

said valve member assembly comprises a shaft with said self-reversing profile, said shaft is actuated axially in opposed directions relative to said at least one wall port for tandem movement with a valve member for said incremental increases and decreases in overlap between said at least one valve member port and said at least one wall port.

4. The assembly of claim 3, wherein:

said shaft is rotationally locked.

5. The assembly of claim 4, wherein:

said shaft is axially driven by said pin extending into said self-reversing profile.

6. The assembly of claim 5, wherein:

said pin is mounted to a sleeve that rotates on its own axis.

7. The assembly of claim 6, wherein:

said sleeve is axially fixed.

8. The assembly of claim 6, wherein:

said j-slot assembly is operated by a shifting tool extending through the tubular string and engaged to a latch profile on said j-slot assembly.

9. The assembly of claim 3, wherein:

said valve member has a bias force acting thereon.

10. The assembly of claim 9, wherein:

said bias force comprises a spring or a compressible pressurized gas.

11. The assembly of claim 9, wherein:

said bias force is overcome with movement of a shifting tool engaged in a latch profile of said j-slot assembly to allow said j-slot pin to move in a continuous j-slot causing a driving rotational force in said self-reversing profile to axially translate said shaft in opposed directions.

12. The assembly of claim 11, wherein:

said shaft axially moves between spaced end points and reverses direction as said shaft reaches each end point.

13. The assembly of claim 1, wherein:

said at least one housing comprises a plurality of spaced housings each comprising a discrete latch profile to be engaged by a shifting tool.

14. The assembly of claim 13, wherein:

a discrete latch profile on discrete said housings is engaged by the shifting tool in a single trip in the tubular string.

15. A flow balancing method for subterranean use, comprising:

running in a plurality of choke valves spaced at predetermined locations on a tubular string;

mechanically positioning each of said valves in open, closed or intermediate positions for flow distribution therethrough;

accomplishing said positioning by axially driving a shaft with a j-slot which rotates a remotely located pin outside said j-slot, said remotely located pin engaged with a spaced apart from said j-slot helical self-reversing profile, said self-reversing profile converting rotational motion of said pin to axial motion of said shaft for automatically reversing rotational direction of said pin which reverses shaft direction at spaced end points representing said open and closed positions.

16. The method of claim 15, comprising:

driving said pin rotatably in said self-reversing profile while constraining said shaft against rotation.

17. The method of claim 16, comprising:

connecting said j-slot to a sleeve with a latch profile;

engaging said latch profile with a shifting tool;

moving a valve member in at least one said choke valve with said shaft.

18. The method of claim 17, comprising:

rotating said sleeve with said j-slot, as a result of reciprocal movement of said shifting tool when engaged to said latch profile, to drive said pin along said self-reversing profile;

applying a bias force to said valve member.

19. The method of claim 18, comprising:

moving said shaft and valve member in tandem continuously between spaced axial end points as a result of axially cycling said shifting tool.

* * * * *